US007965047B2

(12) United States Patent
Wang

(10) Patent No.: US 7,965,047 B2
(45) Date of Patent: Jun. 21, 2011

(54) FLUORESCENT LAMP DRIVING CIRCUIT

(75) Inventor: Chen-Hsung Wang, Sinjhuang (TW)

(73) Assignee: Niko Semiconductor Co., Ltd., Taipei (TW)

( * ) Notice: Subject to any disclaimer, the term of this patent is extended or adjusted under 35 U.S.C. 154(b) by 451 days.

(21) Appl. No.: 12/285,183

(22) Filed: Sep. 30, 2008

(65) Prior Publication Data

US 2009/0278466 A1 Nov. 12, 2009

(30) Foreign Application Priority Data

May 7, 2008 (TW) ..... 97116751 A

(51) Int. Cl.
*H05B 41/36* (2006.01)

(52) U.S. Cl. ..... 315/219; 315/246; 315/177; 315/185 R; 315/291

(58) Field of Classification Search ..... 315/219, 315/278, 224, 308, 294, 312, 292, 246, 276, 315/297, 209 R, 185 R, 307
See application file for complete search history.

(56) References Cited

U.S. PATENT DOCUMENTS

| | | | | |
|---|---|---|---|---|
| 6,104,146 | A * | 8/2000 | Chou et al. | 315/277 |
| 6,670,781 | B2 * | 12/2003 | Weindorf | 315/307 |
| 6,879,114 | B2 * | 4/2005 | Jales et al. | 315/209 R |
| 7,030,569 | B2 * | 4/2006 | Gray | 315/224 |
| 7,095,185 | B2 * | 8/2006 | Nemirow et al. | 315/291 |
| 7,629,758 | B2 * | 12/2009 | Hsiao et al. | 318/293 |
| 2006/0119285 | A1 * | 6/2006 | Gray | 315/224 |
| 2007/0108919 | A1 * | 5/2007 | Tsai et al. | 315/291 |
| 2007/0126372 | A1 * | 6/2007 | Huang et al. | 315/291 |
| 2009/0184671 | A1 * | 7/2009 | Kimura | 315/308 |
| 2009/0267536 | A1 * | 10/2009 | Wang et al. | 315/297 |

* cited by examiner

*Primary Examiner* — Vibol Tan
(74) *Attorney, Agent, or Firm* — Rosenberg, Klein & Lee

(57) ABSTRACT

A fluorescent lamp driving circuit is provided. The fluorescent lamp driving circuit collects a pulse-width-modulation and a MOS switch in a single package. The pulse-width-modulation for driving multiple lamps only needs two pins to achieve feedback control and protection control. Thereby the pins required by the pulse-width-modulation are decreased substantially, and the electronic elements needed for feedback and protection control are also reduced, and the overall circuit design is simplified.

19 Claims, 8 Drawing Sheets

FLUORESCENT LAMP DRIVING CIRCUIT

BACKGROUND OF THE INVENTION

1. Field of the Invention

The present invention is related to a fluorescent lamp driving circuit; in particular, to a multi-lamp driving circuit with built-in MOSFET (Metal Oxide Semiconductor Field Effect Transistor).

2. Description of Related Art

A backlight module of a liquid crystal display uses high-frequency sinusoidal-wave power supply to supply power as the energy required for lighting the Cold Cathode Fluorescent Lamp (CCFL), therefore it is demanded to employ DC/AC inverters to achieve the purpose of energy conversion. An ordinary CCFL driving circuit uses a resonant module to convert a DC voltage into an AC voltage to drive a CCFL to light up. The driving voltage and the driving current of the CCFL are detected by the voltage and current detection circuits. A Pulse-Width-Modulation (PWM) controller receives the generated voltage detection signal and current detection signal for the purposes of stabilizing the illumination of the CCFL and circuit protection.

Due to the trend of large-scaled liquid crystal panel, the number of CCFLs in the backlight module needed to be driven increases accordingly, conventional driving circuit applying single PWM controller and single resonant module for driving single lamp may result in complexity in circuit design as well as increasing of production cost. In order to reduce cost of multi-lamp driving, it is common to apply one PWM controller to control the multi-lamp driving circuit, so as to reduce the number of components and simplify circuit design.

FIG. 1 shows a circuit diagram of a conventional multi-lamp driving circuit. The multi-lamp driving circuit comprises a PWM controller 100, a switch module SW, a resonant module, a multi-lamp module, a plurality of current detection modules 110, 130, and a plurality of voltage detection modules 120, 140, wherein the multi-lamp module consists of a plurality of lamps L1, L2, and the resonant module consists of a transformer T as well as resonant capacitors C1, C2. The switch module SW is connected to an input voltage Vin, and is utilized to control the energy transferred to the resonant module according to the control signals from the PWM controller 100. The secondary side windings of the transformer T are connected to the lamps L1, L2, respectively. The current detection modules 110, 130 are connected in series with the lamps L1, L2 respectively so as to generate current detection signals A1, A4 representing the magnitude of current passing through the lamps L1, L2 respectively, and also to generate lamp status signals A3, A6 representing the status of the lamps L1, L2, respectively. The voltage detection modules 120, 140 are connected in parallel with the lamp L1, L2 respectively so as to generate voltage detection signals A2, A5 representing the magnitude of voltage drop on the lamps L1, L2 respectively. The PWM controller 100 receives the aforementioned signals A1~A6 to performs soft start and feedback control in order to control the power transferred by the switch module SW for stabilizing the illumination of the lamp and also for providing circuit protection upon the occurrence of abnormality in the circuit.

By using the above-described circuit, it is possible to use one PWM controller to control two lamps simultaneously, thus reducing the number of PWM controllers. But, the number of pins of the PWM controller and the required electronic components are still too many, as a result, how to effectively reduce the number of pins needed in the PWM controller and lessen the required electronic components so as to simplify the circuit design, is still a critical topic for present research and development of CCFL driving circuit.

SUMMARY OF THE INVENTION

The object of the present invention is to effectively reduce the number of pins in a PWM controller and lessen the required electronic components, in order to reduce circuit cost as well as simplify circuit layout.

To achieve the above-stated object the present invention provides a fluorescent lamp driving circuit, which comprises a resonant module, a lamp module, a detection device, and a controller. The resonant module has a primary side and a secondary side and is used to convert an input voltage received on the primary side into an AC signal outputted on the secondary side. The resonant module has a transformer. The primary side of the transformer has two connection ends and a central tap end. The lamp module has a plurality of lamps and is coupled to the secondary side of the resonant module to receive the AC signal. The detection device and the lamp module are connected in series to the secondary side of the resonant module and one end of the detection device is connected to a reference potential end (e.g. ground). The detection device generates a current detection signal and a protection feedback signal based on the current flowing through the lamps. The controller has two semiconductor switches, wherein one end of each of the two semiconductor switches is mutually connected, while the other end of each of the two semiconductor switches is coupled to the two connection ends of the primary side of the transformer, respectively. The controller controls the switching of the two semiconductor switches in accordance with the current detection signal so as to stably transfer power of the input voltage to the resonant module. When the protection feedback signal is higher than a first preset value or lower than a second preset value, the controller stops the switching of the two semiconductor switches, wherein the first preset value is greater than the second preset value.

The present invention also provides another fluorescent lamp driving circuit, which comprises a resonant module, a lamp module, a detection device, and a controller. The resonant module has a primary side and a secondary side and is used to convert an input voltage received on the primary side into an AC signal outputted on the secondary side. The lamp module has a plurality of lamps and is coupled to the secondary side of the resonant module to receive the AC signal. The detection device and the lamp module are connected in series to the secondary side of the resonant module and one end of the detection device is connected to a reference potential end (e.g. ground). The detection device generates a current detection signal and a protection feedback signal based on the current flowing through the lamps. The controller has two semiconductor switches, wherein one end of each of the two semiconductor switches is mutually connected, while the other end of each of the two semiconductor switches is respectively coupled to an input voltage source and the reference potential end. The controller controls the switching of the two semiconductor switches in accordance with the current detection signal, so as to stably transfer power of the input voltage to the resonant module. When the protection feedback signal is higher than a first preset value or lower than a second preset value, the controller stops the switching of the two semiconductor switches.

The present invention further provides a fluorescent lamp driving circuit, which comprises a resonant module, a lamp module, a detection device, and a controller. The resonant module has a primary side and a secondary side and is used to convert an input voltage received on the primary side into an AC signal outputted on the secondary side. The lamp module has a plurality of lamps and is coupled to the secondary side of the resonant module to receive the AC signal. The detection device and the lamp module are connected in series to the secondary side of the resonant module and one side of the detection device is connected to a reference potential end (e.g. ground). The detection device generates a current detection signal and a protection feedback signal based on the current flowing through these lamps. The controller has two semiconductor switches, wherein one end of each of the two semiconductor switches is mutually connected and coupled to the primary side of the resonant module. The controller controls the switching of the two semiconductor switches in accordance with the current detection signal, so as to stably transfer power of the input voltage to the resonant module. When the protection feedback signal is lower than a preset value, the controller stops the switching of the two semiconductor switches.

In summary, the present invention provides a fluorescent lamp driving circuit, in the case of simultaneously driving multiple lamps, whose controller needs one pin for receiving the current detection signal to achieve the feature of feedback control, and another pin for receiving the protection feedback signal to offer protection control, as a result, the number of pins in the controller and the corresponding electronic components required for the purposes of feedback and protection are reduced, and circuit design is simplified as well.

The above-mentioned Summary and the following Detailed Descriptions are exemplary, all for further illustrating the claimed scope of the present invention. Other purposes and advantages of the present invention will be explained in the subsequent descriptions and drawings.

DETAILED DESCRIPTION OF PREFERRED EMBODIMENTS

Figure 1:
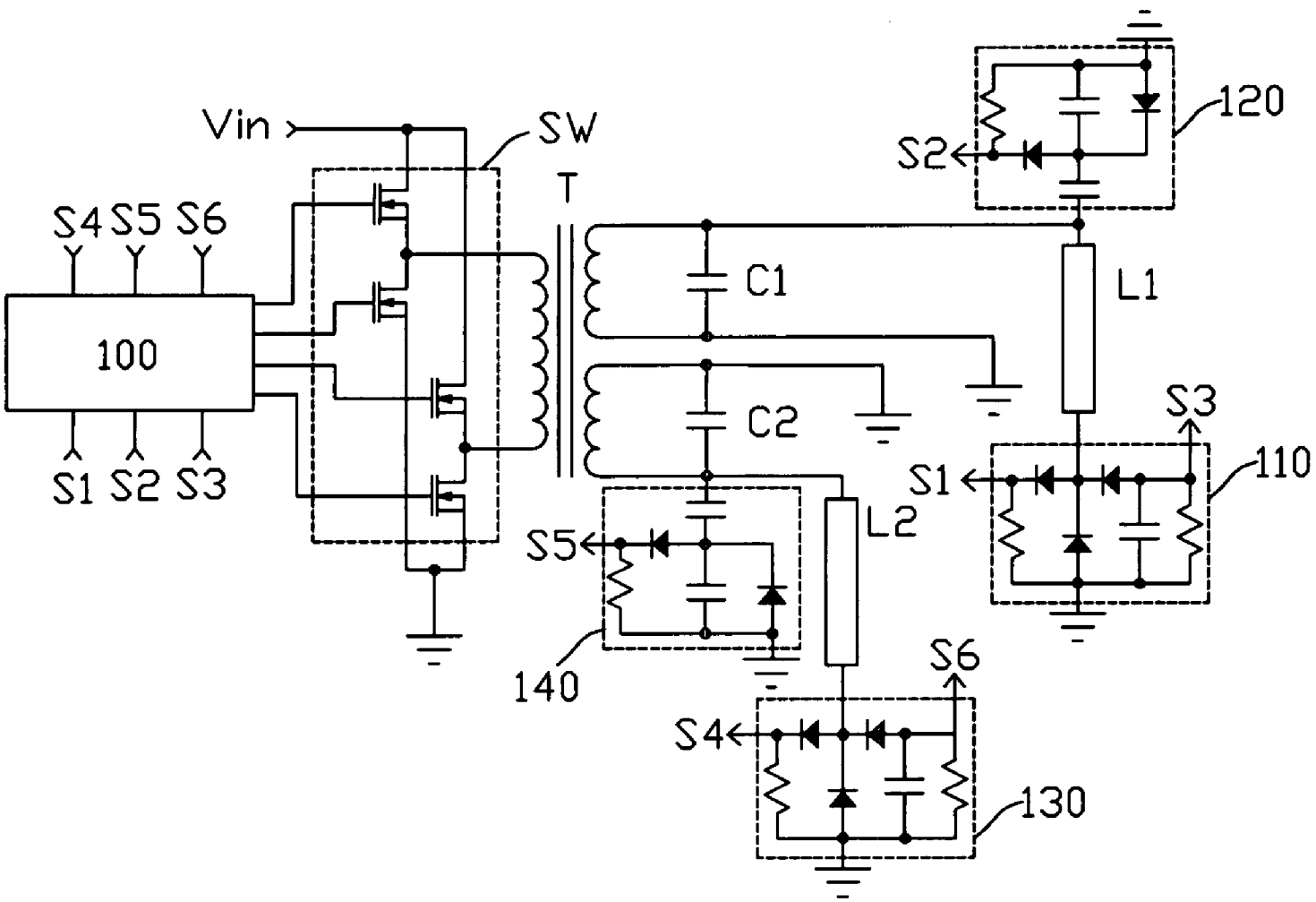
FIG. 1(PRIOR ART)
FIG. 1 shows a circuit diagram of a conventional multi-lamp driving circuit.
Figure 2:
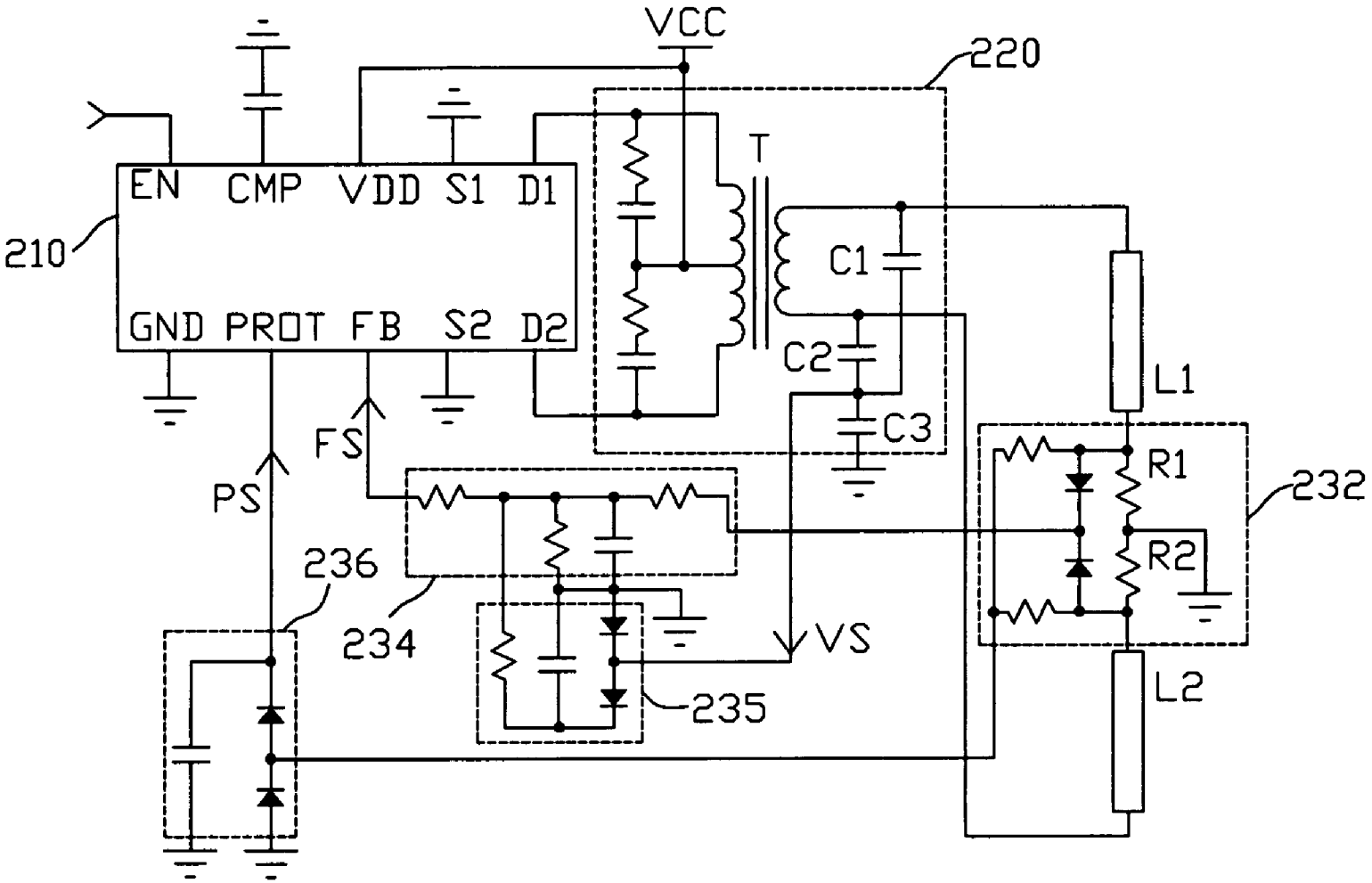
FIG. 2 shows a circuit diagram of the multi-lamp driving circuit in accordance with a first embodiment of the present invention.

Refer now to FIG. 2, which shows a circuit diagram of the multi-lamp driving circuit in accordance with a first embodiment of the present invention, the multi-lamp driving circuit has a controller 210, a resonant module 220, a lamp module, and a detection device. The lamp module has lamps L1, L2. The detection device has a detection part 232, a current detection feedback part 234, a voltage detection feedback part 235, and a protection detection feedback part 236. The resonant module 220 has a primary side and a secondary side. The primary has a transformer T and resonant capacitors C1~C3. The primary side of the transformer T has two connection ends and a central tap end, wherein the central tap end is connected to an input voltage source VCC, and the two connection ends are respectively connected to the pins D1, D2 of the controller 210. In this way, the resonant module 220 may convert the power of the input voltage from the input voltage source VCC received on the primary side into an AC signal outputted on the secondary side for operating the lamp module. The lamp module has a plurality of lamps. Every two lamps in the lamp module are connected in series to the secondary side of the resonant module 220 to receive the AC signal, respectively. In the present embodiment, the lamps L1, L2 are connected in series to the secondary side of the resonant module 220. The detection part 232 of the detection device and the lamp module are connected in series to the secondary side of the resonant module 220, and one end of the detection part 232 is connected to a reference potential end (e.g. ground). The detection part 232 detects the current flowing through the lamp module by using the resistors R1, R2 to generate a detection signal and transfers the detection signal to the current detection feedback part 234 and the protection detection feedback part 236, respectively. In the present embodiment, the protection detection feedback part 236 has two diodes and a capacitor. The protection detection feedback part 236 receives the detection signal, rectifies the detection signal by using the diode, converts the detection signal into a protection feedback signal PS, and outputs the protection feedback signal PS to a protection pin PROT in the controller 210. The current detection feedback part 234 rectifies and converts the detection signal into a current detection signal FS and outputs the current detection signal FS to a feedback pin FB of the controller 210. In addition, the output voltage of the resonant module 220 is divided by the resonant capacitors C1~C3 to generate a voltage division signal VS applied to the voltage detection feedback part 235 in order to provide over-voltage protection.

Under normal operation, a stable current is generated flowing through the resonant module 220. The stable current passes through the resistors R1, R2 and generates stable detection signal. At this moment, the level of the detection signal is located within a safe range. Upon the occurrence of short-circuit in the multi-lamp driving circuit, a larger current is generated flowing through the resonant module 220. Upon the occurrence of open-circuit in the multi-lamp driving circuit, a smaller current is generated flowing through the resonant module 220. Both of the aforementioned situations cause the level of the detection signal to deviate beyond a safe range (i.e. greater than an upper limit or smaller than a lower limit). Therefore, the controller 210 determines whether it is required to enter into a protection status based on the protection feedback signal PS. Also, when the voltage on the secondary side of the resonant module 220 shows abnormally surges, the level of the voltage division signal VS will be higher than the level of the detection signal, thus pulls up the level of the current detection signal FS, such that the controller 210 reduces the power inputted to the resonant module 220 so as to decrease the voltage on the secondary side. The controller 210 has two built-in semiconductor switches (not shown in FIG. 2, but will be described in more detail later in FIG. 7), wherein one end of each of the two semiconductor switches is mutually connected and also connected to the reference potential end, and the other end of each of the two semiconductor switches is respectively coupled to the two connection ends on the primary side of the transformer T. The controller 210 receives a high level enable signal at the enable pin EN thereof and then starts to operate. The switching of the two semiconductor switches is controlled based on the current detection signal FS so as to control the magnitude of the power inputted by the input voltage source VCC to the resonant module 220, thus provides the function of output stabilization. While the protection feedback signal PS is higher than a first preset value or lower than a second preset value (the first preset value is greater than the second preset value), the controller 210 stops switching of the two semiconductor switches and enters into the protection status in order to protect the circuit from being damaged.

Figure 3:
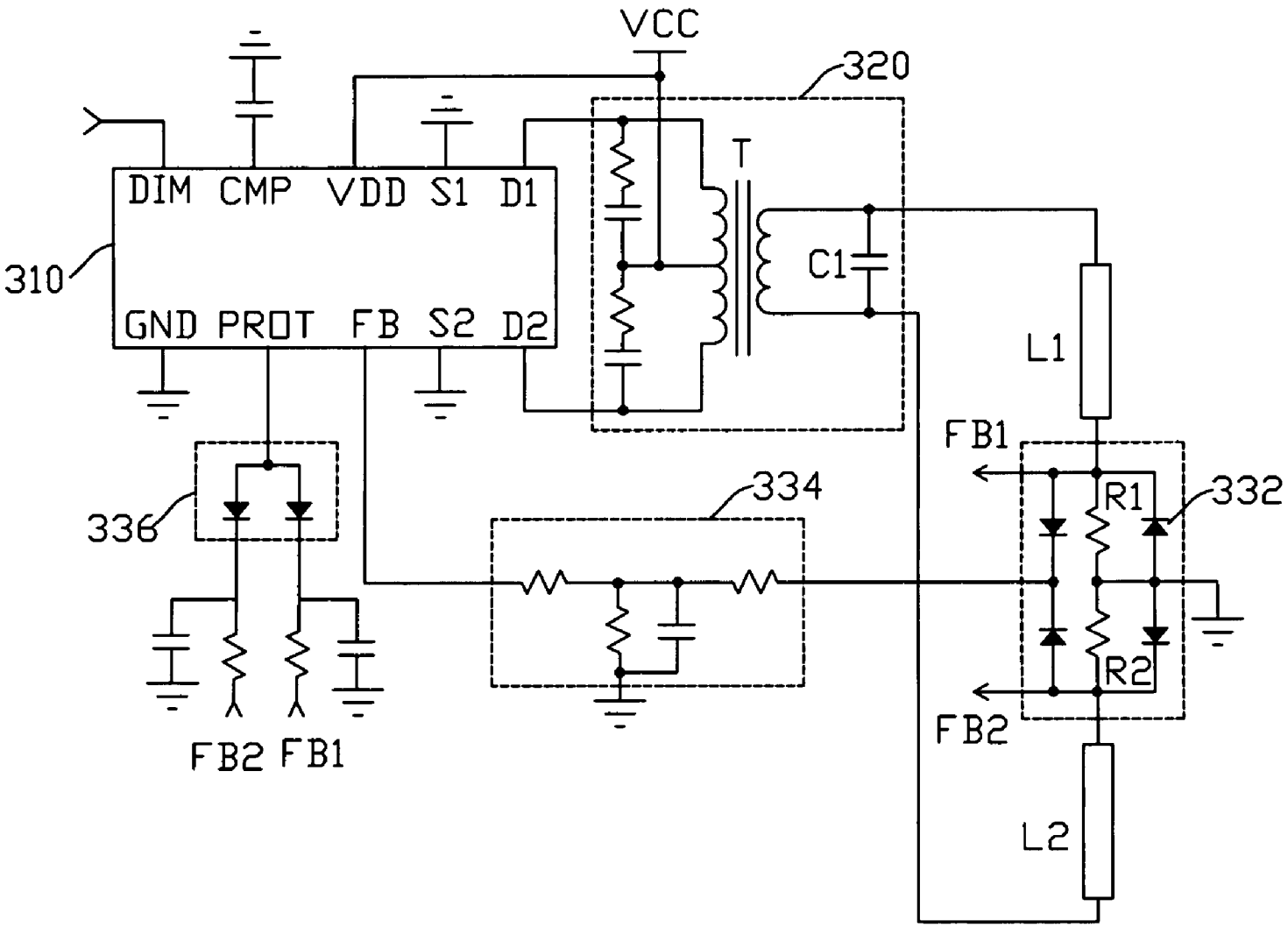
FIG. 3 shows a circuit diagram of the multi-lamp driving circuit in accordance with a second embodiment of the present invention.

Next refer to FIG. 3, wherein a circuit diagram of the multi-lamp driving circuit in accordance with a second embodiment of the present invention is shown. Similarly, the multi-lamp driving circuit of the present embodiment comprises a controller 310, a resonant module 320, a lamp module, and a detection device. The lamp module has lamps L1, L2. The detection device includes a detection part 332, a current detection feedback part 334, and a protection detection feedback part 336. Compared with the first embodiment of FIG. 2, the major difference lies in that, failure of any lamp L1, L2 in the lamp module of the second embodiment to result in open-circuit will break the current loop of the secondary side of the resonant module 320, which causes the lamp current becomes zero. In this case, the level at the protection pin PROT of the controller 310 is pulled down by the detection signals FB1, FB2 through the protection detection feedback part 336 to have the controller 310 enter the protection status. Also, in the second embodiment, the controller 310 may receive a dimming signal of DC level dimming or pulse dimming via a dimming pin DIM, so as to control the switching of the two semiconductor switches according to the dimming signal in order to show the feature of dimming the lamps.

In the aforementioned two embodiments, the resonant module and the semiconductor switches in the controller form a push-pull converter. The following embodiment takes a half-bridge converter as an example for illustration. However, the circuits described in these embodiments can be mutually exchanged is well known to those skilled in the art, and the scope of the present invention is by no means limited thereto.

Figure 4:
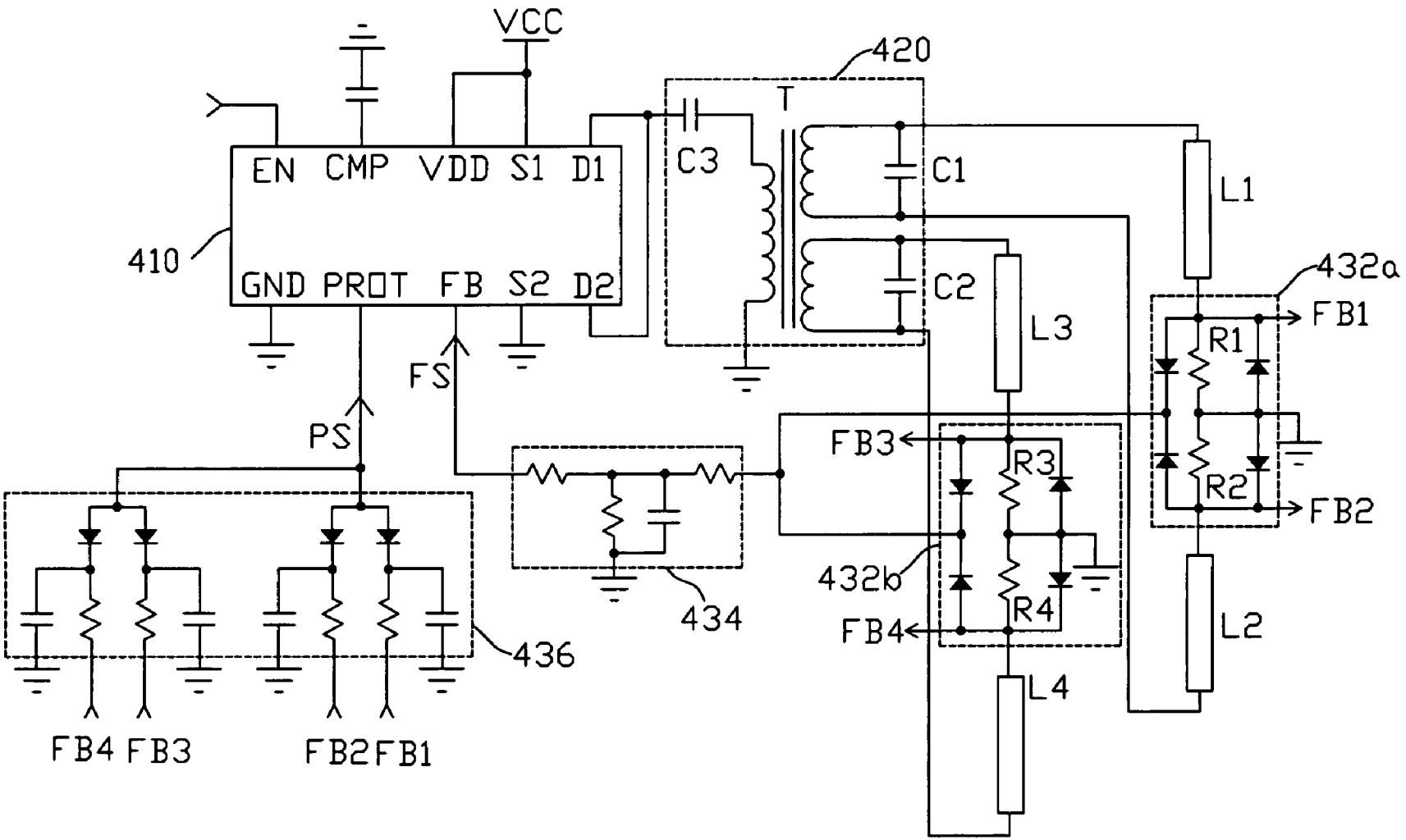
FIG. 4 shows a circuit diagram of the multi-lamp driving circuit in accordance with a third embodiment of the present invention.

Refer now to FIG. 4, a circuit diagram of the multi-lamp driving circuit in accordance with a third embodiment of the present invention is shown. The multi-lamp driving circuit of the present embodiment comprises a controller 410, a resonant module 420, a lamp module, and a detection device. The lamp module has lamps L1~L4. The detection device includes two detection parts 432*a*, 432*b*, a current detection feedback part 434, and a protection detection feedback part 436. The resonant module 420 has a primary side and a secondary side and primarily has a transformer T and resonant capacitors C1~C3 for converting the power received on the primary side into an AC signal outputted on the secondary side. The secondary side of the transformer T has two windings. The lamp module has a plurality of lamps L1~L4, wherein lamps L1, L2 are coupled in series to a winding on the secondary side of the transformer T, and lamps L3, L4 are coupled in series to the other winding on the secondary side of the transformer T. The detection part 432*a* of the detection device and the lamps L1, L2 are coupled in series to the secondary side of the resonant module 420, and one end of the detection part 432*a* of the detection device is connected to a reference potential end (i.e. ground) to generate the detection signals FB1, FB2. Meanwhile, the detection part 432*b* and the lamps L3, L4 are coupled in series to the secondary side of the resonant module 420, and one end of the detection part 432*b* is connected to the reference potential end (i.e. ground) to generate the detection signals FB3, FB4. When the AC signal outputted by the resonant module 420 is at the positive half-wave, current sequentially flows through the lamp L1, the resistor R1, the diode connected in parallel to the resistor R2, and the lamp L2, and thus the detection signal FB1 is outputted. When the AC signal is at the negative half-wave, current sequentially flows through the lamp L2, the resistor R2, the diode connected in parallel to the resistor R1, and the lamp L1, and thus the detection signal FB2 is outputted. Therefore, the detection device according to the present invention has the function of time-sharing outputting the detection signals of the different lamps to the protection pin PROT. The detection signal is rectified before outputted to the current detection feedback part 434, and then filtered by the current detection feedback part 434 and transferred to the feedback pin FB of the controller 410, as a result, the feedback control of the controller 410 would not be affected by the time-sharing outputted detection signals. The controller 410 has two built-in semiconductor switches (not shown), wherein one end of the each of the two semiconductor switches is mutually connected and also connected to the primary side of the resonant module 420, while the other end of each of the two semiconductor switches is coupled to an input voltage source VCC and the reference potential end, respectively. The controller 420 starts to operate upon the reception of the high level enable signal at the enable pin EN, and controls the switching of the two semiconductor switches based on the current detection signal FS to control the magnitude of power inputted by the input voltage VCC to the resonant module 420 so as to achieve the effect of output stabilization. As the protection feedback signal PS becomes higher than the first preset value or lower than the second preset value (the first preset value is greater than the second preset value), the controller 410 stops the switching of the two semiconductor switches and enters into the protection status to avoid circuit destruction.

In the present embodiment, although the number of lamps is greater than the aforementioned embodiments, because the detection device has time-sharing function to output detection signal of each lamps and the protection detection feedback part 436 receiving these detection signals is capable of selectively outputting the abnormal detection signals to the protection pin PROT of the controller 410, the function of circuit protection can be achieved.

Figure 5:
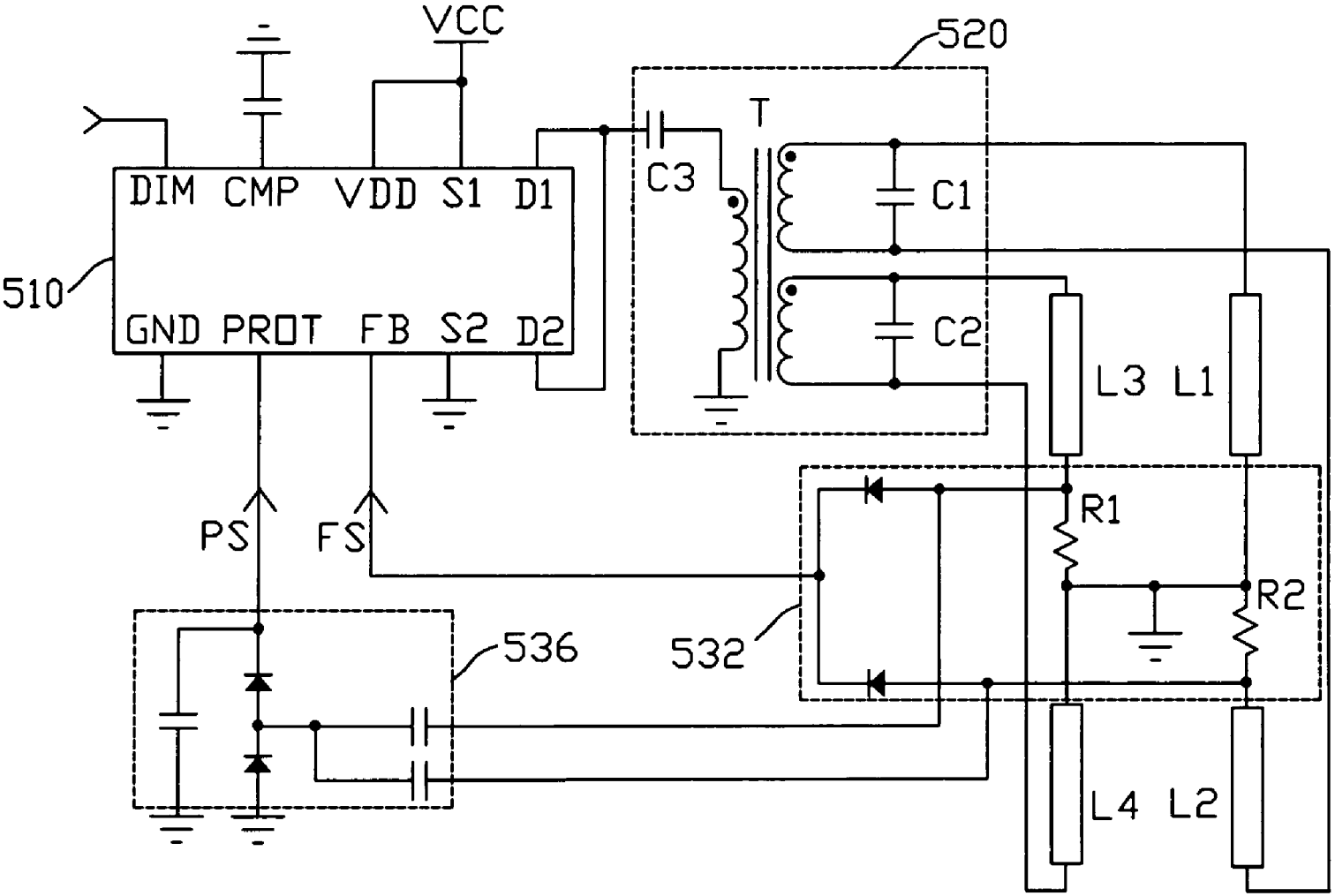
FIG. 5 shows a circuit diagram of the multi-lamp driving circuit in accordance with a fourth embodiment of the present invention.

Subsequently, refer to FIG. 5, wherein a circuit diagram of the multi-lamp driving circuit in accordance with a fourth embodiment of the present invention is shown. The multi-lamp driving circuit of the present embodiment comprises a controller 510, a resonant module 520, a lamp module, and a detection device. The lamp module has lamps L1~L4. The detection device has a detection part 532 and a protection detection feedback part 536. Compared with the third embodiment in FIG. 4, the major difference lies in the design of the detection device. In detail, in the present embodiment, the polarities of the two windings on the secondary side of the transformer T are opposite, the current flowing through the resistor R1 in the detection part 532 and the current flowing through the resistor R2 are substantially opposite in phase. As a result, under normal operations, the level of the protection feedback signal outputted from the protection detection feedback part 536 is located around zero. However, in case an abnormality occurs in the circuit, the difference of magnitude between the detection signals generated by the resistor R1 and in the resistor R2 would be increased and/or the phase difference between the detection signals would be deviated away from 180 degrees. In both cases, the level of the protection feedback signal PS would be increased. After the level of the protection feedback signal PS exceeds a preset value, the controller 510 stops providing the power from the input voltage source VCC to the resonant module 520, in order to provide the function of circuit protection. It is obvious that the external electronic components employed in the embodiment of FIG. 5 are more concise in contrast with that of FIG. 4 and thus the circuit cost can be further reduced.

Figure 6:
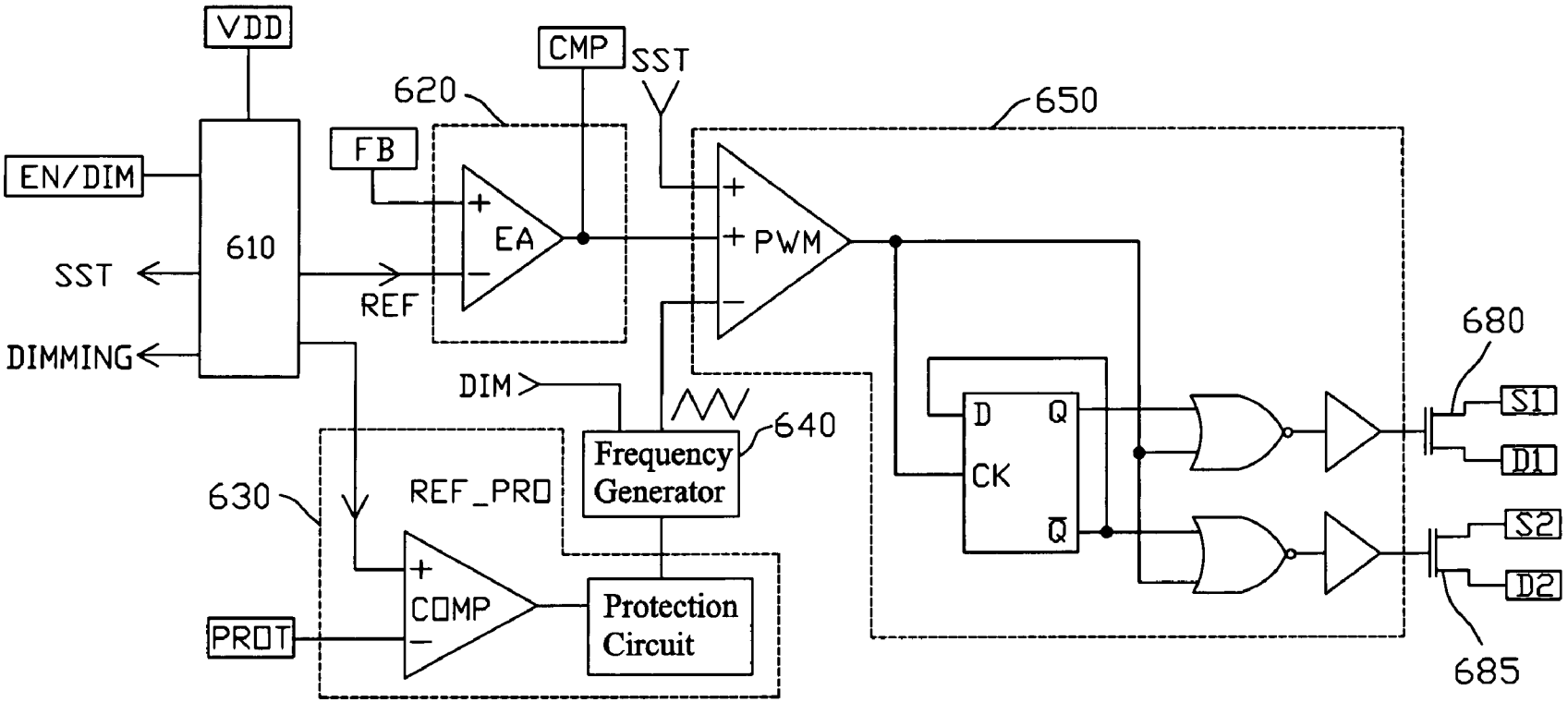
FIG. 6 shows a circuit diagram of the controller applicable to the embodiments in FIGS. 3 and 4.

Next, refer to FIG. 6, wherein a circuit diagram of the controller applicable to the embodiments in FIGS. 3 and 4 is shown. As shown, the controller substantially comprises a processing unit 610, an error amplification unit 620, a protection unit 630, a frequency generator 640, a PWM unit 650, a first semiconductor switch 680, and a second semiconductor switch 685. The first semiconductor switch 680 and the second semiconductor switch 685 may be MOS transistors, BJT transistors, silicon controlled rectifier (SCR), silicon bidirectional thyristor (TRAIC), and so forth. The processing unit 610 receives the high level enable signal from the enable/dimming pin EN/DIM and starts to operate. At the moment, the processing unit 610 generates voltage reference signals REF, REF_PRO and a soft start signal SST. The two input ends of the error amplification unit 620 respectively receives the voltage reference signal REF and the current detection signal inputted from the feedback pin FB to generate an error amplification signal. The protection unit 630 includes a protection comparator COMP and a protection circuit. The protection comparator COMP receives the voltage reference signal REF_PRO and the protection feedback signal inputted from the protection pin PROT. When the level of the protection feedback signal is lower than the level of voltage reference signal REF_PRO, the protection comparator COMP generates a protection comparison signal. After receiving the protection comparison signal, the protection circuit will generate a frequency-conversion control signal in a predetermined period of time. Whereas, as the protection comparison signal lasts over the predetermined period of time, the protection circuit may generate a protection control signal. The frequency generator 640 generates a slope signal at a normal operation frequency. Upon the reception of the frequency-conversion control signal, the frequency generator 640 increases the operation frequency to strike the lamps. In addition, after a period of time since the reception of the protection control signal, the frequency generator 640 stops its operations. The PWM unit 650 receives the soft start signal SST, the error amplification signal, and the slope signal, and accordingly generates two driving signals to control the switching of first semiconductor switch 680 and the second semiconductor switch 685 respectively.

At the beginning of the initializing the multi-lamp driving circuit, the lamp has not yet been struck and the level of the protection feedback signal is extremely low, therefore the protection circuit generates the frequency-conversion control signal first. At this moment, the frequency generator 640 operates at the start-up frequency as the protection feedback signal is lower than a preset value (i.e. the level of the voltage reference signal REF_PRO). As the level of soft start signal SST gradually rises, duty cycle of the driving signal generated by the PWM unit 650 increases gradually, and the output voltage on the secondary side of the resonant module increase gradually to strike the lamp. When the lamp is started successfully, the level of the protection feedback signal exceeds the preset value. At this moment the frequency generator 640 operates at the normal operation frequency, wherein the start-up frequency is higher than the normal operation frequency. Additionally, in case the lamp fails to be started or some abnormal conditions occur in the circuit, the protection feedback signal remains continuously lower than the preset value over a preset period of time. At this moment, the frequency generator 640 stops operating, causing the PWM unit 650 to stop generating the driving signal and having the controller enter into the protection status.

When the signal from the enable/dimming pin EN/DIM turns to be a dimming signal, the processing unit 610 determines the dimming signal based on the frequency or level of the signal received from the enable/dimming pin EN/DIM and generates a dimming control signal DIMMING based on the dimming signal. The dimming control signal DIMMING is transferred to the frequency generator 640, making the frequency generator 640 stop operating to achieve the objective of dimming lamps.

Figure 7:
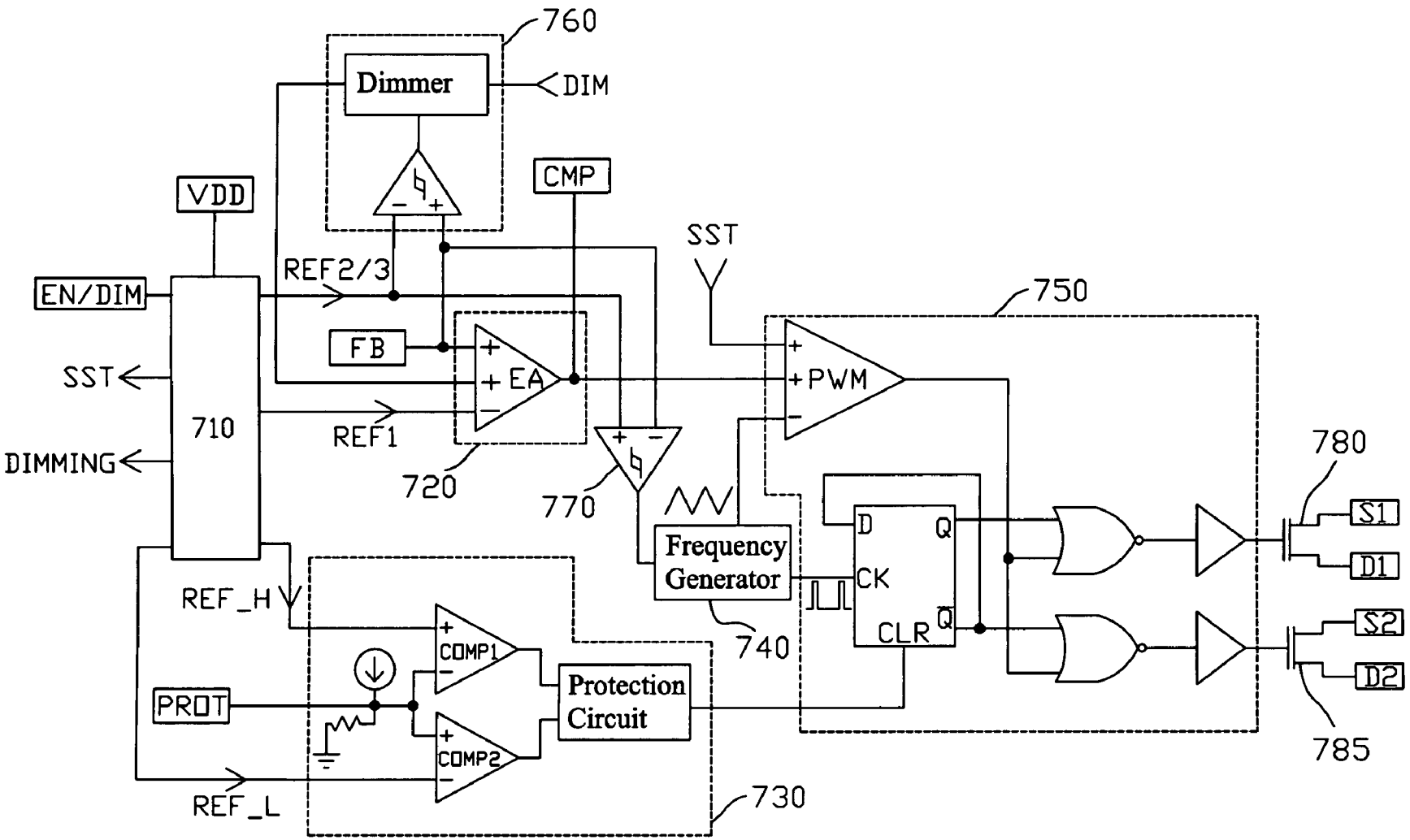
FIG. 7 shows a circuit diagram of the controller applicable to the embodiments in FIGS. 2 and 5.

Next, refer to FIG. 7, in which a circuit diagram of the controller applicable to the embodiments in FIGS. 2 and 5 is shown. The controller of the present embodiment comprises a processing unit 710, an error amplification unit 720, a protection unit 730, a frequency generator 740, a PWM unit 750, a dimming unit 760, a frequency-conversion hysteresis comparator 770, a first semiconductor switch 780, and a second semiconductor switch 785. The first semiconductor switch 780 and the second semiconductor switch 785 may be MOS transistors, BJT transistors, SCR, TRAIC, and so forth. The processing unit 710 receives the high-level enable signal from the enable/dimming pin EN/DIM and starts to operate. At the moment, the processing unit 710 generates voltage reference signals REF1, REF2/3, REF_H, REF_L, a dimming control signal DIMMING, and a soft start signal SST. The three input ends of the error amplification unit 720 receives the voltage reference signal REF1, current detection signal inputted from the feedback pin FB, and the dimming signal transferred by the dimming unit 760, respectively, and the error amplification unit 720 accordingly generates an error amplification signal. The protection unit 730 has a first protection comparator COMP1, a second protection comparator COMP2, a protection circuit, and a current source. The non-inverted input end of the first protection comparator COMP1 receives the voltage reference signal REF_H and the inverted input end of the first protection comparator COMP1 receives the protection feedback signal inputted from the protection pin PROT. When the level of the protection feedback signal is higher than the level of the voltage reference signal REF_H, the first protection comparator COMP1 generates a first protection comparison signal. The non-inverted input end of the second protection comparator COMP2 receives the voltage reference signal REF_L and the inverted input end of the second protection comparator COMP2 receives the protection feedback signal. When the level of the protection feedback signal is lower than the level of the voltage reference signal REF_L, the second protection comparator COMP2 generates a second protection comparison signal. The level of the voltage reference signal REF_H is higher than that of the voltage reference signal REF_L. The protection circuit is coupled to the input ends of the first comparator COMP1 and the second comparator COMP2 to receive the protection comparison signals and generates a protection control signal. As a preferred embodiment, when any of these protection comparison signals continuously lasts over a predetermined period of time, the protection control signal is generated to stop the switching of the first semiconductor switch 780 and the second semiconductor switch 785 via the PWM unit 750.

A current source is coupled to the protection pin PROT, and the level of the protection pin PROT can be pulled upward by using a resistor. Thereby, during normal circuit operations, the level on the protection pin PROT is kept to fall within the range between the levels of the voltage reference signal REF_H and the voltage reference signal REF_L to prevent the protection unit 730 from wrongly operating.

The frequency-conversion hysteresis comparator 770 receives the voltage reference signal REF2/3 and the current detection signal inputted from the feedback pin FB. When the lamp has not been started, the current detection signal is lower than the voltage reference signal REF2/3, and the frequency-conversion hysteresis comparator 770 generates a frequency-conversion control signal. The dimming unit 760 has a dimmer and a hysteresis comparator. The hysteresis comparator receives the voltage reference signal REF2/3 and the current detection signal inputted from the feedback pin FB. The dimmer receives the dimming control signal DIMMING. When the lamp has not been started yet, the current detection signal is lower than the voltage reference signal REF2/3. At this time, the dimmer blocks the output of the dimming control signal DIMMING to isolate the striking of the lamp from dimming function of the controller. When the lamp has been started, the level of the current detection signal is higher than the voltage reference signal REF2/3. At this time, the dimmer outputs the dimming signal, such that the controller starts to perform dimming function. The frequency generator 740 operates at a normal operation frequency to generate a slope signal. When the frequency-conversion control signal generated by the frequency-conversion hysteresis comparator 770 is received, the frequency generator 740 turns to operate at a higher start-up frequency to strike the lamp. The PWM unit 750 receives the soft start signal SST, the error amplification signal, the protection control signal, and the slope signal, and accordingly generates two driving signals to respectively control the switching of the first semiconductor switch 780 and the second semiconductor switch 785.

In the embodiment of FIG. 7, it is also possible, as the embodiment shown in FIG. 6, to replace the frequency conversion hysteresis comparator 770 with the protection unit 730 in order to control the operating frequency of the frequency generator 740. When the level of the protection feedback signal falls within the range between the levels of the voltage reference signal REF_H and the voltage reference signal REF_L, the frequency generator 740 operates at the normal operation frequency, whereas, when the level of the protection feedback signal is higher than the level of the voltage reference signal REF_H or lower than the level of the voltage reference signal REF_L, the frequency generator 740 operates at a start-up frequency so as to achieve the function of frequency-conversion for striking lamp.

Figure 8:
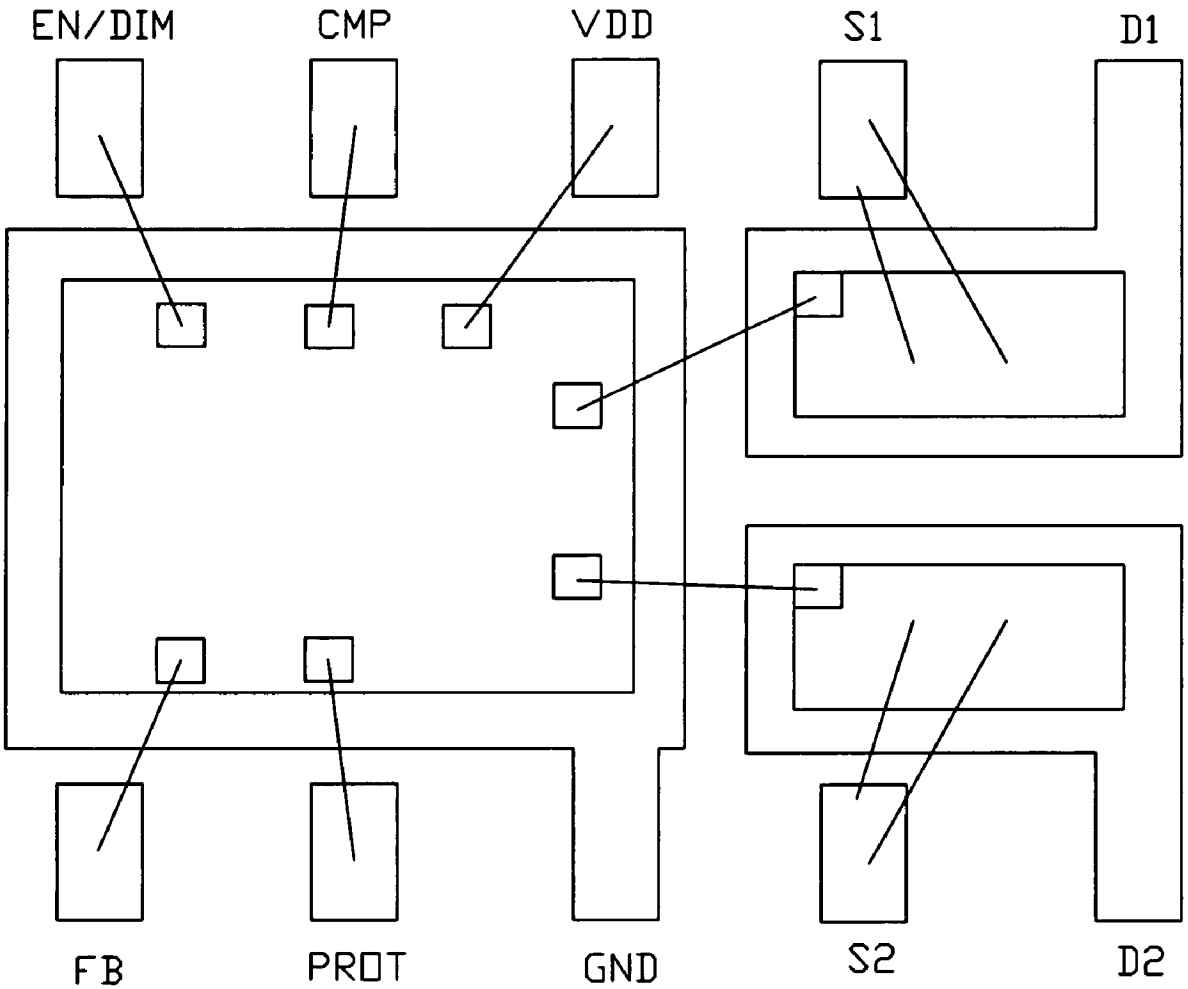
FIG. 8 is a schematic view showing a package structure of the controller according to the present invention.

FIG. 8 is a schematic view showing a package structure of the controller according to the present invention, wherein the feedback pin FB and the protection pin PROT are separated from the pins D1, S1, D2, S2 of the two semiconductor switches by more than one pin so as to avoid the levels of the signals received at the feedback pin FB and the protection pin PROT from being influenced by the pins of the two semiconductor switches due to the coupling effect. Since the semiconductor switches and the PWM are encapsulated in the same package and the controller needs only one single pin to receive the current detection signal to achieve feedback control and another pin to receive the protection feedback signal to provide protection control, the number of pins of the controller can thus be significantly reduced and the packaging cost can be effectively reduced. Meanwhile, the external electronic components demanded for feedback control and protection control are reduced and the circuit layout is simplified.

The aforementioned discussions simply present the preferred embodiment of the present invention, but the scope of the present invention is by no means limited thereto. All changes or modifications in the field of the present invention that any skilled ones in the art can conveniently consider are deemed to be embraced by the scope of the present invention delineated in the following claims.

What is claimed is:

1. A fluorescent lamp driving circuit, comprising:

a resonant module, with a primary side and a secondary side, used to convert an input voltage received on the primary side into an AC signal outputted on the secondary side, the resonant module having a transformer, and a primary side of the transformer having two connection ends and a central tap end;

a lamp module, which has a plurality of lamps, coupled to the secondary side of the resonant module to receive the AC signal;

a detection device, wherein the detection device and the lamp module are serially connected to the secondary side of the resonant module, having one end thereof connected to a reference potential end, and generating a current detection signal and a protection feedback signal based on the current flowing through the plurality of lamps; and a controller, having two semiconductor switches, one end of each of the two semiconductor switches being mutually connected, the other end of each of the two semiconductor switches being coupled to the two connection ends of the primary side of the transformer, respectively;

wherein the controller controls the switching of the two semiconductor switches in accordance with the current detection signal to stably transfer power of the input voltage to the resonant module, when the protection feedback signal is higher than a first preset value or lower than a second preset value, the controller stops the switching of the two semiconductor switches, and the first preset value is greater than the second preset value.

2. The fluorescent lamp driving circuit according to claim 1, wherein the controller further comprises a first comparator and a second comparator, a non-inverted input end of the first comparator receives a first reference voltage signal representing the first preset value, an inverted input end of the second comparator receives a second reference voltage signal representing the second preset value, and an inverted input end of the first comparator and a non-inverted input end of the second comparator receive the protection feedback signal.

3. The fluorescent lamp driving circuit according to claim 1, wherein the controller further comprises a protection circuit, coupled to an output end of the first comparator and an output end of the second comparator, so as to output a protection control signal based on the comparing result of the first comparator and the second comparator to control the switching of the two semiconductor switches.

4. The fluorescent lamp driving circuit according to claim 1, wherein the switching of the two semiconductor switches is stopped when the protection feedback signal higher than the first preset value or lower than the second preset value lasts for a predetermined period of time.

5. The fluorescent lamp driving circuit according to claim 1, wherein the controller further comprises a frequency generator, which operates at a first frequency when the level of the protection feedback signal is between the first preset value and the second preset value, and operates at a second frequency when the level of the protection feedback signal is higher than the first preset value or lower than the second preset value, wherein the second frequency is higher than the first frequency.

6. The fluorescent lamp driving circuit according to claim 5, wherein the controller receives a dimming signal, and when the frequency generator operates at the first frequency, the controller controls the switching of the two semiconductor switches for dimming the lamps based on the dimming signal.

7. The fluorescent lamp driving circuit according to claim 1, wherein the detection device comprises:

a detection part, used to detect the current through the lamps to generate a detection signal;

a current detection feedback part, coupled to the detection part and having the detection signal rectified to generate the current detection signal; and a protection detection feedback part, coupled to the detection part and having the detection signal rectified to generate the protection feedback signal.

8. A fluorescent lamp driving circuit, comprising:

a resonant module, with a primary side and a secondary side, for converting an input voltage received on the primary side into an AC signal outputted on the secondary side;

a lamp module, which has a plurality of lamps, coupled to the secondary side of the resonant module to receive the AC signal;

a detection device, wherein the detection device and the lamp module are serially connected to the secondary side of the resonant module, having one end thereof connected to a reference potential end, and generating a current detection signal and a protection feedback signal based on the current flowing through the lamps; and a controller, having two semiconductor switches, one end of each of the two semiconductor switches is mutually connected, and the other ends of the two switches are coupled to an input voltage source and the reference potential end, respectively;

wherein the controller controls the switching of the two semiconductor switches in accordance with the current detection signal to stably transfer power of the input voltage to the resonant module, and when the protection feedback signal is higher than a first preset value or lower than a second preset value, the controller stops the switching of the two semiconductor switches.

9. The fluorescent lamp driving circuit according to claim 8, wherein the controller further comprises a first comparator and a second comparator, a non-inverted input end of the first comparator receives a first reference voltage signal representing the first preset value, an inverted input end of the second comparator receives a second reference voltage signal representing the second preset value, and an inverted input end of the first comparator and a non-inverted input end of the second comparator receive the protection feedback signal.

10. The fluorescent lamp driving circuit according to claim 8, wherein the controller further comprises a protection circuit, coupled to an output end of the first comparator and an output end of the second comparator, so as to output a protection control signal based on the comparing result of the first comparator and the second comparator to control the switching of the two semiconductor switches.

11. The fluorescent lamp driving circuit according to claim 8, wherein the switching of the two semiconductor switches is stopped when the protection feedback signal higher than the first preset value or lower than the second preset value lasts for a predetermined period of time.

12. The fluorescent lamp driving circuit according to claim 8, wherein the controller further comprises a frequency generator, which operates at a first frequency when the level of the protection feedback signal is between the first preset value and the second preset value, and operates at a second frequency when the level of the protection feedback signal is higher than the first preset value or lower than the second preset value, wherein the second frequency is higher than the first frequency.

13. The fluorescent lamp driving circuit according to claim 12, wherein the controller receives a dimming signal, and when the frequency generator operates at the first frequency, the controller controls the switching of the two semiconductor switches for dimming the lamps based on the dimming signal.

14. The fluorescent lamp driving circuit according to claim 8, wherein the detection device comprises:

a detection part, used to detect the current through the lamps to generate a detection signal;

a current detection feedback part, coupled to the detection part and having the detection signal rectified to generate the current detection signal; and a protection detection feedback part, coupled to the detection part and having the detection signal rectified to generate the protection feedback signal.

15. A fluorescent lamp driving circuit, comprising:

a resonant module, with a primary side and a secondary side, for converting an input voltage received on the primary side into an AC signal outputted on the secondary side;

a lamp module, which has a plurality of lamps, coupled to the secondary side of the resonant module to receive the AC signal;

a detection device, wherein the detection device and the lamp module are serially connected to the secondary side of the resonant module, having one end thereof connected to a reference potential end, and generating a current detection signal and a protection feedback signal based on the current flowing through the lamps; and a controller, having two semiconductor switches, wherein one end of each of the two semiconductor switches is mutually connected and coupled to the primary side of the resonant module;

wherein the controller controls the switching of the two semiconductor switches in accordance with the current detection signal to stably transfer power of the input voltage to the resonant module, and when the protection feedback signal is lower than a preset value, the controller stops the switching of the two semiconductor switches.

16. The fluorescent lamp driving circuit according to claim 15, wherein the detection device comprises:

a detection part, used to detect the current through the lamps to generate a detection signal;

a current detection feedback part, coupled to the detection part and having the detection signal rectified to generate the current detection signal; and a protection detection feedback part, coupled to the detection part and having the detection signal rectified to generate the protection feedback signal.

17. The fluorescent lamp driving circuit according to claim 16, wherein the switching of the two semiconductor switches stops when the protection feedback signal lower than the preset value lasts for a predetermined period of time.

18. The fluorescent lamp driving circuit according to claim 17, wherein the controller further comprises a frequency generator, which operates at a first frequency when the level of the protection feedback signal is higher than the preset value, and operates at a second frequency when the level of the protection feedback signal lower than the preset value, wherein the second frequency is higher than the first frequency.

19. The fluorescent lamp driving circuit according to claim 18, wherein the controller receives a dimming signal, and when the frequency generator operates at the first frequency, the controller controls the switching of the two semiconductor switches for dimming the lamps based on the dimming signal.

* * * * *